US008162147B1

(12) United States Patent
Ting et al.

(10) Patent No.: US 8,162,147 B1
(45) Date of Patent: Apr. 24, 2012

(54) BOX FOR TRANSPORTING

(75) Inventors: Yun-Lung Ting, Taoyung County (TW); Hao-Yang Chang, Taoyuan County (TW); Ming-Chi Huang, Taoyuan County (TW); Hsin-An Chen, Yunlin County (TW); Chiao-Yi Chang, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 13/050,923

(22) Filed: Mar. 17, 2011

(30) Foreign Application Priority Data

Dec. 30, 2010 (TW) ..... 99146761 A

(51) Int. Cl.
*B65D 85/00* (2006.01)

(52) U.S. Cl. ..... 206/707; 206/723; 206/454

(58) Field of Classification Search ..... 206/454, 206/455, 456, 305, 706, 707, 708, 709, 701, 206/722, 723; 220/532, 533, 552
See application file for complete search history.

(56) References Cited

U.S. PATENT DOCUMENTS 3,820,679 A * 6/1974 Schweitzer ..... 220/507
3,920,144 A * 11/1975 Callen ..... 220/533
4,602,715 A 7/1986 Sarver et al.
4,779,752 A * 10/1988 Vallee et al. ..... 220/533
4,798,305 A * 1/1989 Laverty ..... 220/533
5,096,056 A * 3/1992 Garcia ..... 206/749
5,782,356 A * 7/1998 Hugg ..... 206/454
6,910,583 B2 * 6/2005 Chen et al. ..... 206/707

FOREIGN PATENT DOCUMENTS

TW 200508109 3/2005

OTHER PUBLICATIONS

"First Office Action of China Counterpart Application", issued on Nov. 2, 2011, p. 1-p. 5.

* cited by examiner

*Primary Examiner* — Jacob K Ackun
(74) *Attorney, Agent, or Firm* — Jianq Chyun IP Office

(57) ABSTRACT

A box for transporting is suitable for preserving a plurality of substrates. The box for transporting includes a box body and at least one partition plate. The box body has a bottom part and a plurality of first sidewalls. A plurality of first bumps arranged in array is disposed on the bottom part, and the first bumps define a plurality of supporting regions. The first sidewalls are connected to the bottom part, and a plurality of major grooves is disposed in inner surfaces of the first sidewalls, wherein a first preserving space is surrounded by the bottom part and the first sidewalls. The partition plate is leant against the supporting regions and inlayed into the major grooves, so as to divide the first preserving space into a plurality of preserving sub-spaces.

17 Claims, 18 Drawing Sheets

BOX FOR TRANSPORTING

CROSS-REFERENCE TO RELATED APPLICATION

This application claims the priority benefit of Taiwan application serial no. 99146761, filed on Dec. 30, 2010. The entirety of the above-mentioned patent application is hereby incorporated by reference herein and made a part of this specification.

BACKGROUND OF THE INVENTION

1. Field of the Invention

The invention relates to a box for transporting, and more particularly to a box for transporting substrates.

2. Description of Related Art

Generally, in the manufacturing process of the photo-electronic industry or other electronic industries, raw materials, semi-finished products or products, such as a glass, an active device array substrate, a color filter, a display panel, a touch sensor panel and an e-paper, is packaged in the box for transporting and then is transported to factories to perform assembling, processing, testing, and so on. Accordingly, process yield is greatly influenced by storing methods and buffer effects of the box for transporting, and space and time for transporting the substrates are also greatly affected by the number and the types of the substrates which can be contained in the box for transporting. Therefore, the manufacturing cost of the products is also affected.

Generally, the substrates are horizontally placed in or inlaid into a conventional box for transporting. Since the capacity configured to place the substrates or the size of the insertion slot is constant, the size of the substrate to be placed is limited. However, as the technology advances rapidly, the turnover rate of the information electronic products is increasing, and therefore electronic products with various sizes have been continuously launched. Thus, new boxes for transporting these substrates with different sizes are required, and the original boxes for transporting are continuously eliminated, which is a vast waste of packaging materials. As described above, it is important for the researchers to develop a box for transporting and placing substrates with various sizes to save the manufacturing cost of the products.

SUMMARY OF THE INVENTION

The invention provides a box for transporting which is capable of placing substrates with various sizes.

The invention provides a box for transporting which is suitable for preserving a plurality of substrates. The box for transporting includes a box body and at least one partition plate. The box body has a bottom part and a plurality of first sidewalls. A plurality of first bumps arranged in array is disposed on the bottom part, and the first bumps define a plurality of supporting regions. The first sidewalls are connected to the bottom part, wherein a plurality of major grooves is disposed in inner surfaces of the first sidewalls, and a first preserving space is surrounded by the bottom part and the first sidewalls. The partition plate is leant against the supporting regions and inlaid into the major grooves to divide the first preserving space into a plurality of preserving sub-spaces.

Accordingly, in the box for transporting of the invention, the partition plate is leant against the supporting regions and inlaid into the major grooves to divide the preserving space into a plurality of preserving sub-spaces, and thus the box for transporting is capable of preserving the substrates with various sizes.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
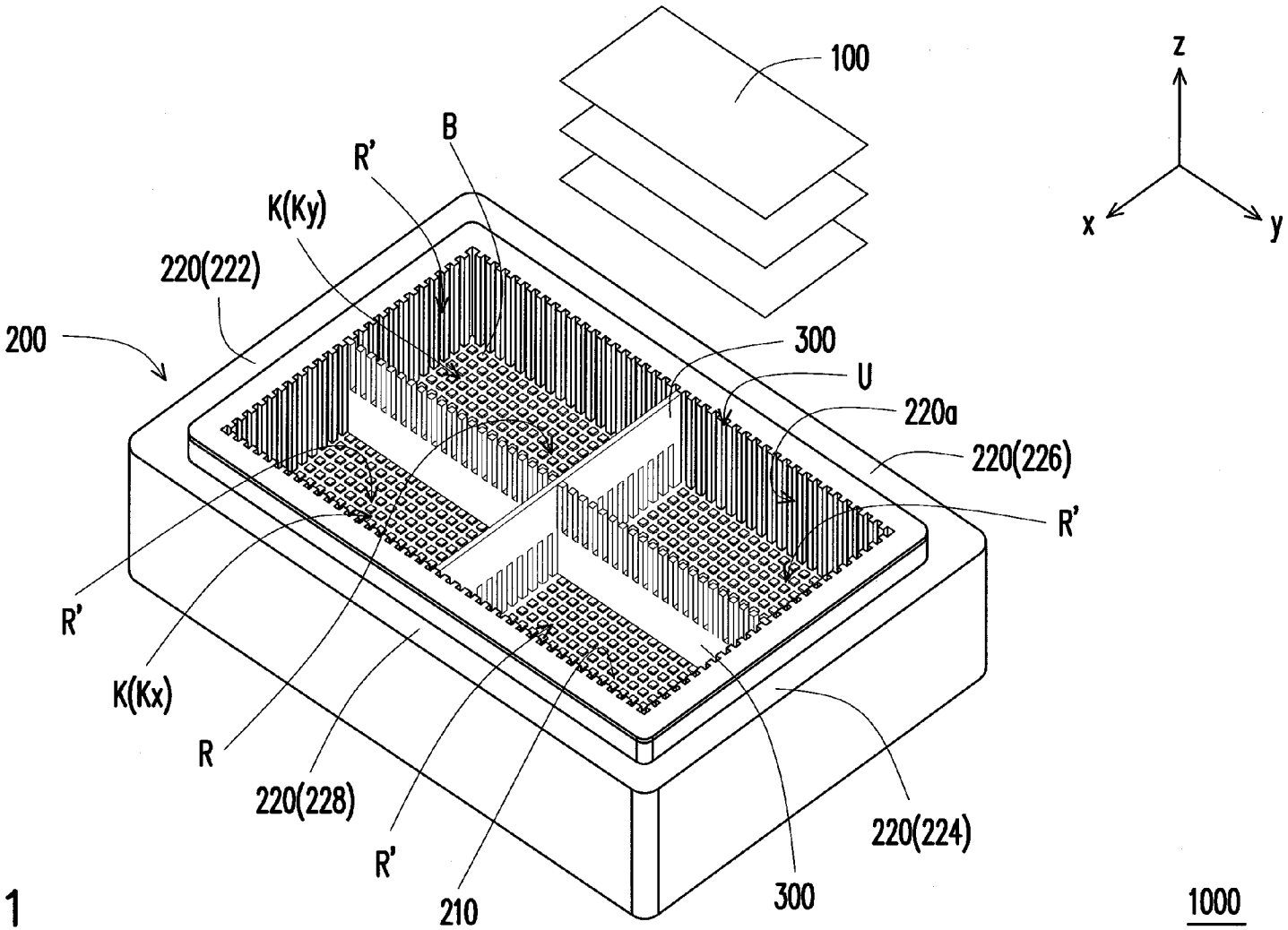
FIGS. 1, 4, 6, 8, 9, 10, 11, 12, 13, 14 and 15 are schematic perspective views illustrating a box for transporting according to an embodiment of the invention.

FIG. 1 is a schematic perspective view illustrating a box for transporting according to an embodiment of the invention. Referring FIG. 1, the box for transporting 1000 of the present embodiment is suitable for preserving a plurality of substrates 100, and the box for transporting 1000 includes a box body 200 and at least one partition plate 300. In the present embodiment, the substrates 100 are glasses, active device array substrates, color filters, display panels, touch sensor panels, e-papers or other plate-shaped objects, for example.

The box body 200 of the present embodiment has a bottom part 210 and a plurality of first sidewalls 220. In the present embodiment, a plurality of first bumps B arranged in array is disposed on the bottom part 210, and the first bumps B define a plurality of supporting regions K. Particularly, the first bumps B have a thickness in a range of 5 mm to 20 mm. The supporting regions K defined by the first bumps B can include a plurality of supporting regions Kx and a plurality of supporting regions Ky, the supporting regions Kx are extended along an x direction and parallel to each other, the supporting regions Ky are extended along a y direction and parallel to each other, and the supporting regions Kx and the supporting regions Ky cross each other to form a network. In the present embodiment, a material of the box body 200 is common material or antistatic material, such as high-density polypropylene (PP), high-density polyethylene (HDPE) and green paper plastic material.

In the present embodiment, the bottom part 210 is connected to the first sidewalls 220 to surround a first preserving space R, wherein a plurality of major grooves U is disposed in inner surfaces 220*a* of the first sidewalls 220. Particularly, the box body 200 of the present embodiment has one bottom part 210 and four first sidewalls 222, 224, 226 and 228. The first sidewall 222 is connected to the bottom part 210, and the first sidewall 224 is connected to the bottom part 210 and disposed opposite to the first sidewall 222. The first sidewall 226 is connected to the bottom part 210 and the first sidewalls 222 and 224. The first sidewall 228 is connected to the bottom part 210 and the first sidewalls 222 and 224 and disposed opposite to the first sidewall 226, and the first preserving space R is surrounded by the bottom part 210 and the first sidewalls 222, 224, 226 and 228. It should be mentioned that the major grooves U are extended along a z direction and disposed in the inner surfaces of the first sidewalls 222, 224, 226 and 228, and the major grooves U are disposed corresponding to the supporting regions K in the present embodiment.

Figure 2:
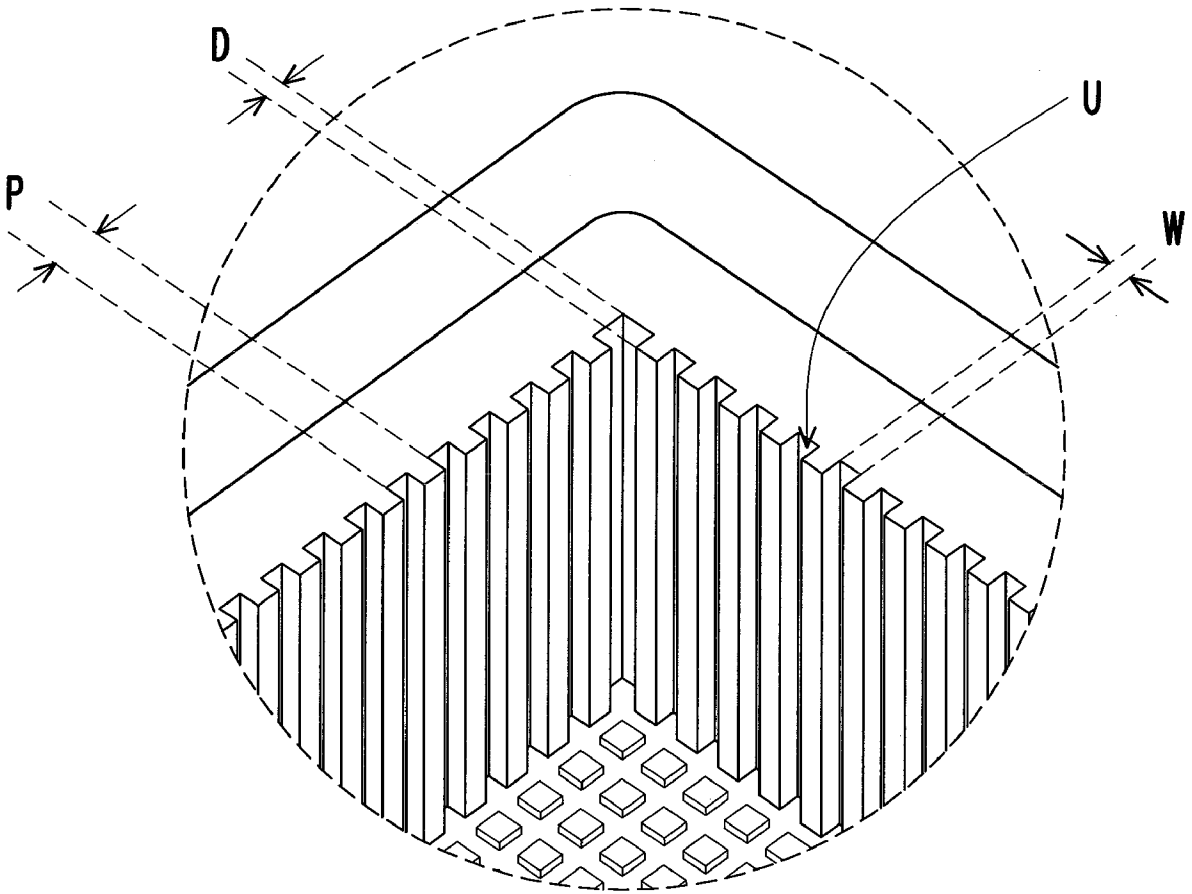
FIG. 2 is a locally enlarged diagram illustrating a corner of the box body in FIG. 1.

FIG. 2 is a locally enlarged diagram illustrating a corner of the box body in FIG. 1. Referring to FIG. 2, in the present embodiment, the major grooves U can have a width W in a range of 3 mm to 20 mm. The major grooves U can have a depth D in a range of 5 mm to 25 mm. The pitch P between the adjacent major grooves U can range from 6 mm to 40 mm. It should be noted that, the pitch P between the adjacent major grooves U is 10 mm in the present embodiment, and the invention is not limited thereto. In other embodiments, the pitch P between the adjacent major grooves U can be varied. In other words, in other embodiments, the pitch P between the adjacent major grooves U disposed in the first sidewalls 222 and 224 can be 10 mm, and the pitch P between the adjacent major grooves U disposed in the first sidewalls 226 and 228 can be 20 mm. However, the invention is not limited herein, and the width W and the depth D of the major groove U and the pitch P between the adjacent major grooves U can be designed according to the actual requirement.

In the invention, at least one partition plate 300 is leant against the supporting regions K and inlaid into the major grooves U, so as to divide the first preserving space R into a plurality of preserving sub-spaces R'. In detail, the partition plate 300 is leant against the supporting regions Kx and inlaid into the major grooves U disposed in the first sidewalls 226 and 228, and another partition plate 300 is leant against the supporting regions Ky and inlaid into the major grooves U disposed in the first sidewalls 222 and 224, so as to divide the first preserving space R into four preserving sub-spaces R'. Therefore, the box for transporting 1000, which originally preserves the substrates 100 with the same size, is capable of preserving the substrates 100 with various sizes, and the function of the box for transporting 1000 is increased.

Figure 3A:
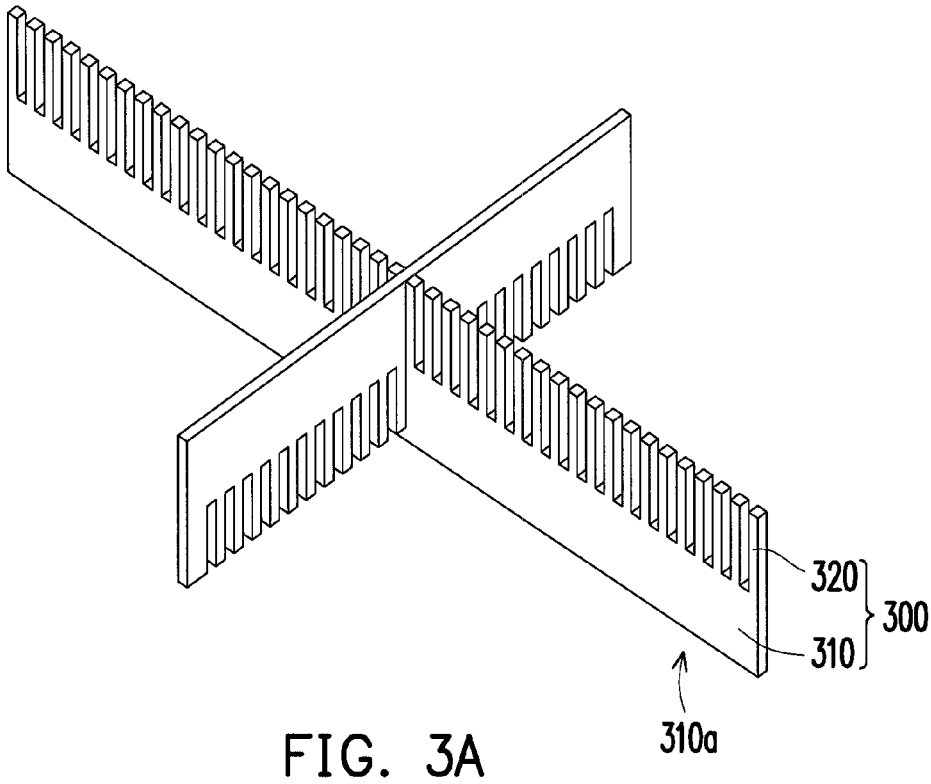
FIGS. 3A, 3B, 3C, 3D and 3G are schematic perspective views illustrating a partition plate according to an embodiment of the invention.
Figure 3B:
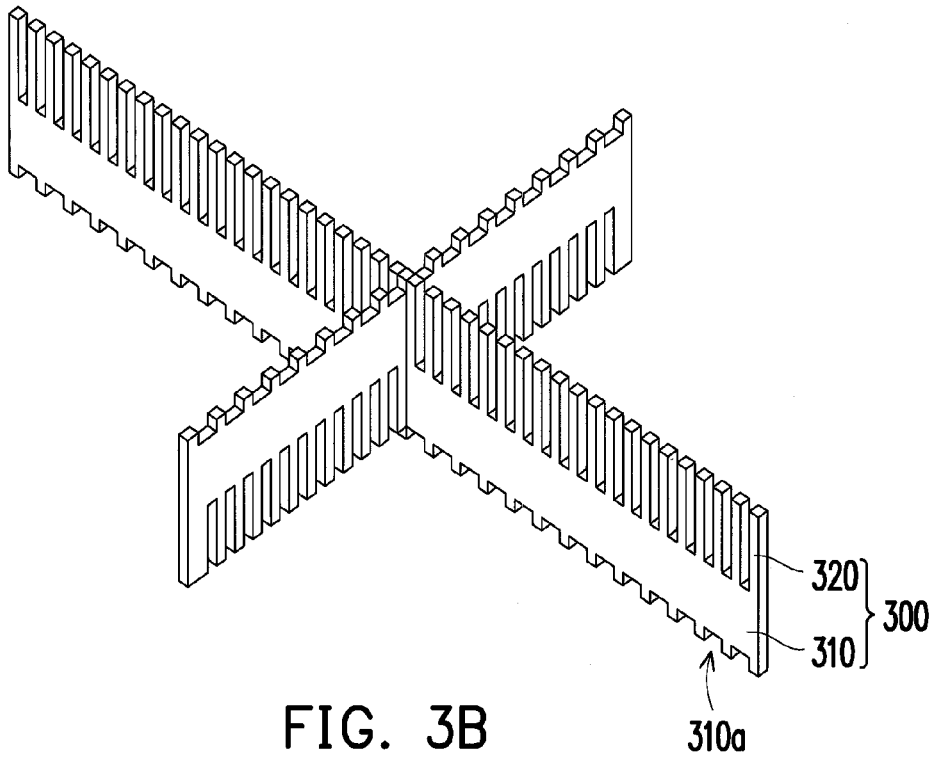
Figure 3C:
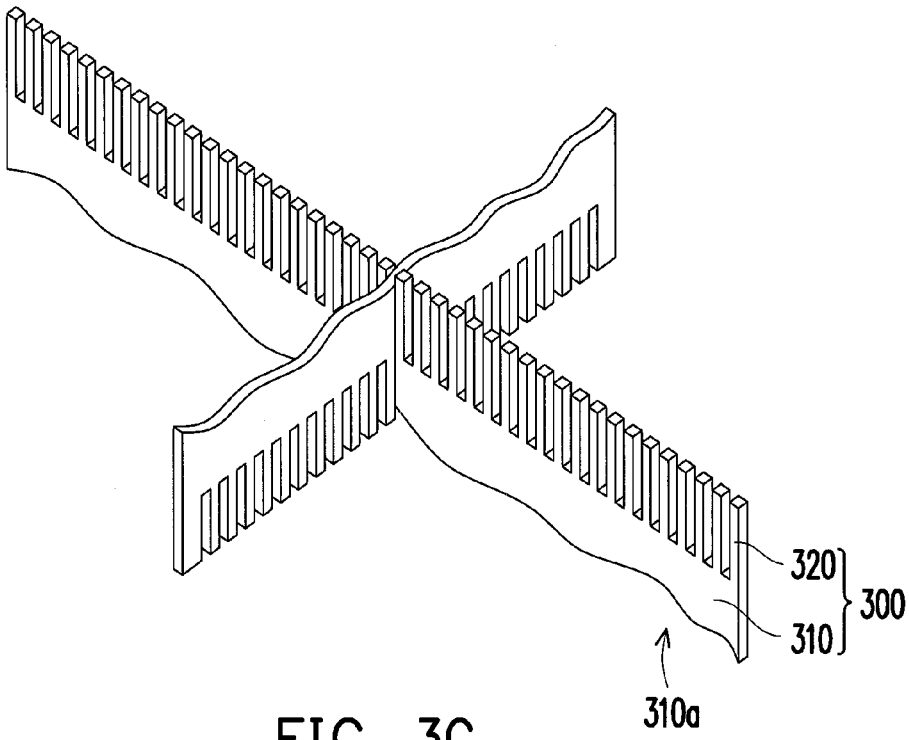
Figure 3D:
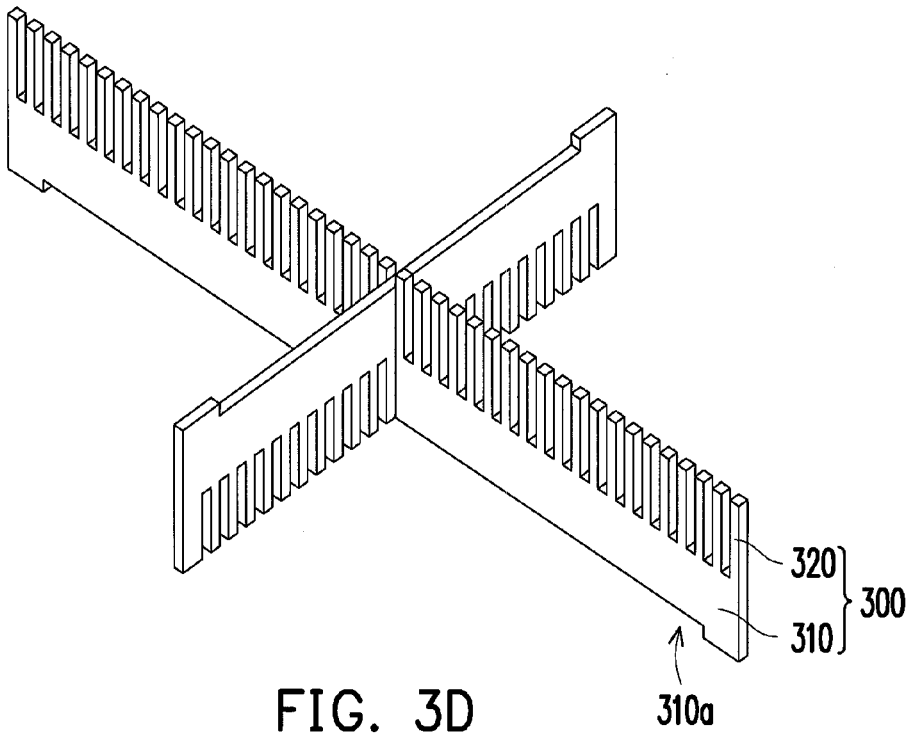
Figure 3E:
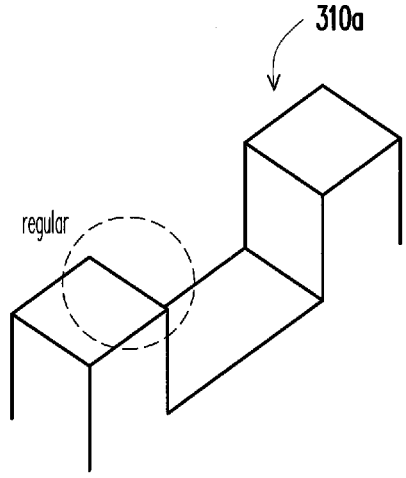
FIGS. 3E and 3F are locally enlarged diagrams illustrating a side of a partition plate according to an embodiment of the invention.
Figure 3F:
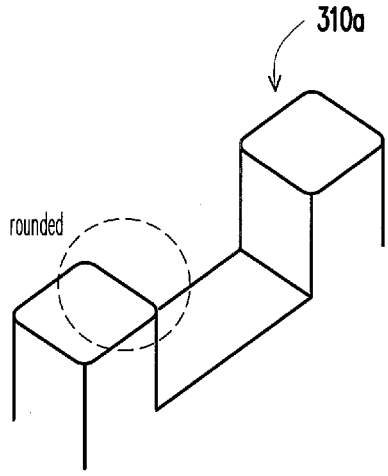

As shown in FIGS. 3A to 3D, the partition plate 300 of the present embodiment is comb-shaped, and includes a connection portion 310 and a plurality of branch portions 320. Particularly, a side 310*a* of the connection portion 310 can have many forms, such as a smooth side shown in FIG. 3A, a town wall-shaped side shown in FIG. 3B, a wave-shaped side shown in FIG. 3C or a square-U shaped side shown in FIG. 3D. Furthermore, in the present embodiment, an edge of the side 310*a* of the partition plate 300 is regular as shown in FIG. 3E or rounded as shown in FIG. 3F. Similarly, in the present embodiment, an edge of the branch portion 320 of the partition plate 300 can be regular or rounded. Nevertheless, the invention should not be construed as limited to the embodiments set forth herein. In the present embodiment, a material of the partition plate 300 is common material or antistatic material, such as high-density polypropylene (PP), high-density polyethylene (HDPE) and green paper plastic material.

Figure 3G:
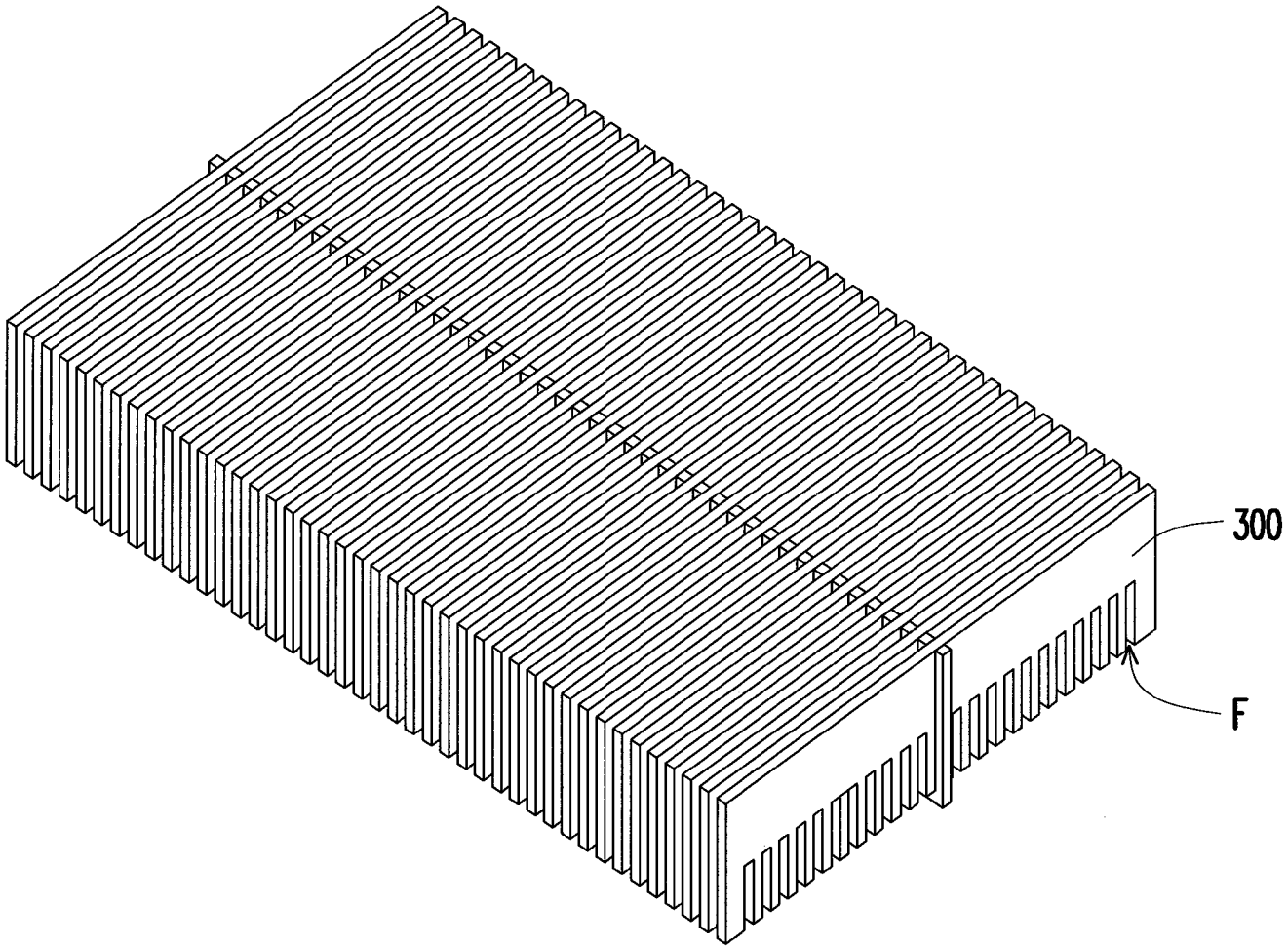
Figure 4:
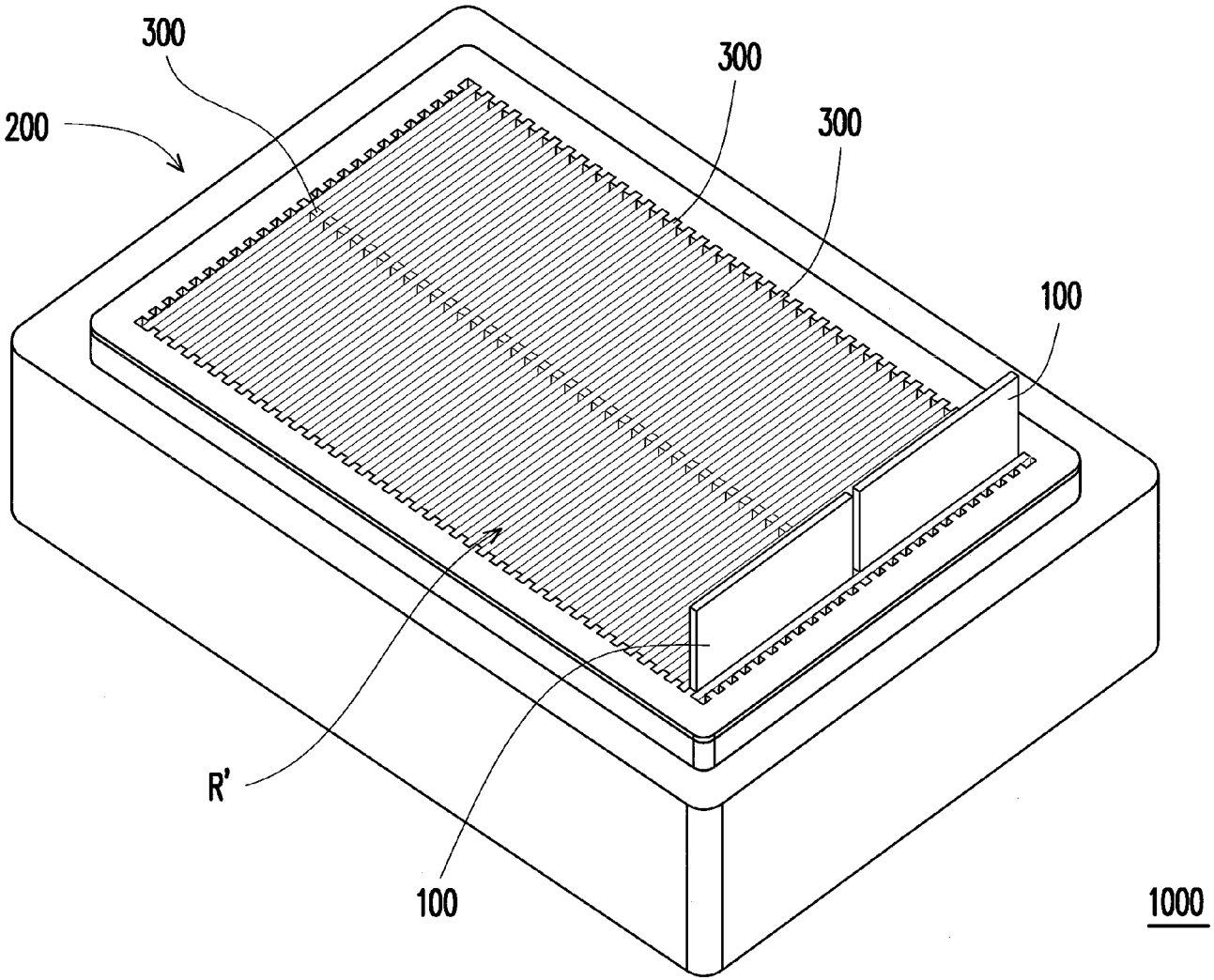

The partition plate 300 of the present embodiment can be flexibly adjusted corresponding to the box body 200. Particularly, the comb-shaped partition plate 300 of the present embodiment includes a plurality of insertion slots F, and the comb-shaped partition plate 300 and other partition plates 300 can insert mutually through the insertion slots F as shown in FIG. 3G. Accordingly, the first preserving space R is further divided into a plurality of preserving sub-spaces R' as shown in FIG. 4, and the preserving sub-spaces R' are suitable for a plurality of the substrates 100 to be inserted vertically. In other words, by flexibly using the partition plates 300, the first preserving space R can be divided into a plurality of preserving sub-spaces R' with different forms. Therefore, the substrates 100 with various sizes can be placed vertically or horizontally into the box for transporting 1000.

Figure 5:
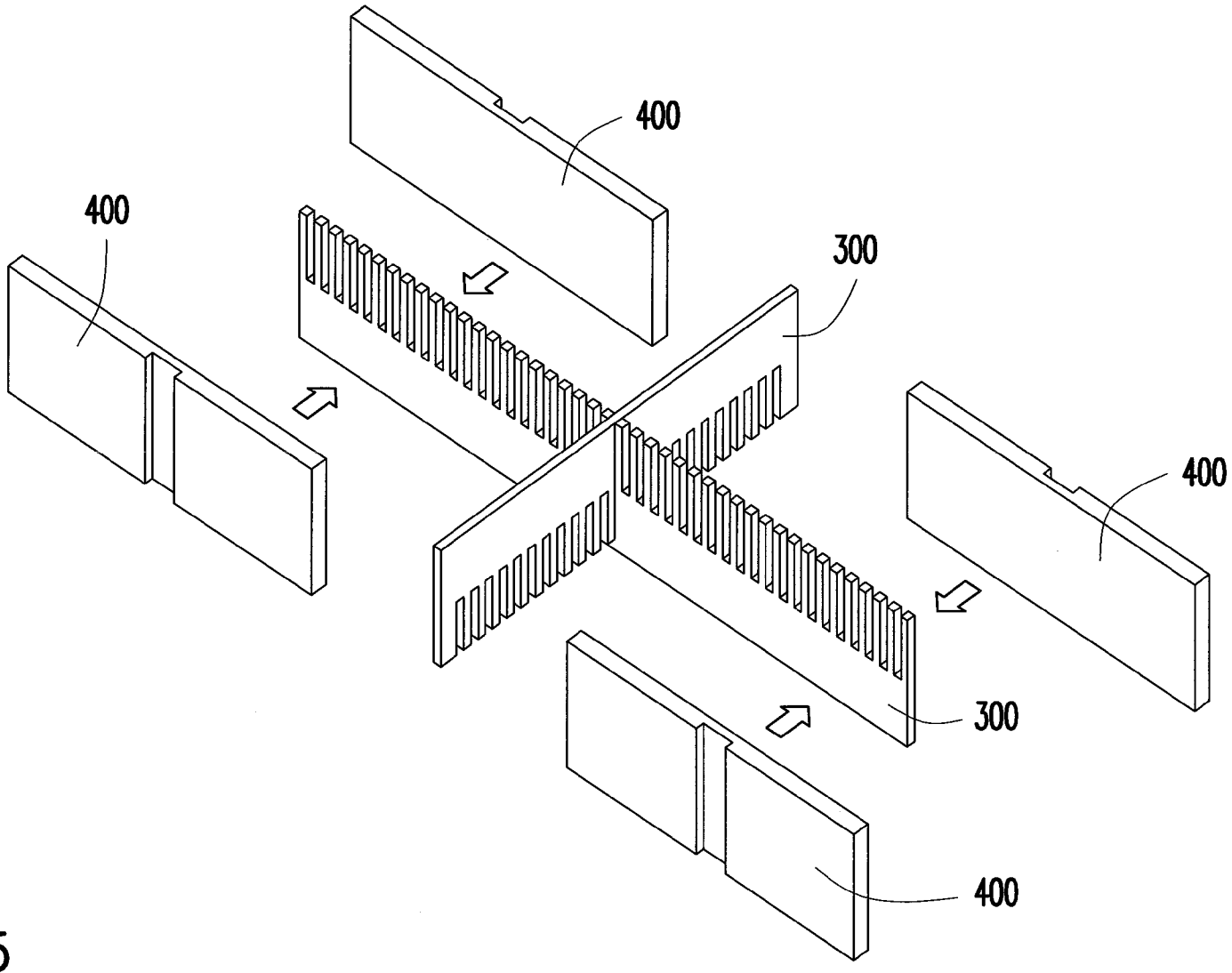
FIG. 5 is a schematic perspective view illustrating a pick-and-place auxiliary member according to an embodiment of the invention.
Figure 6:
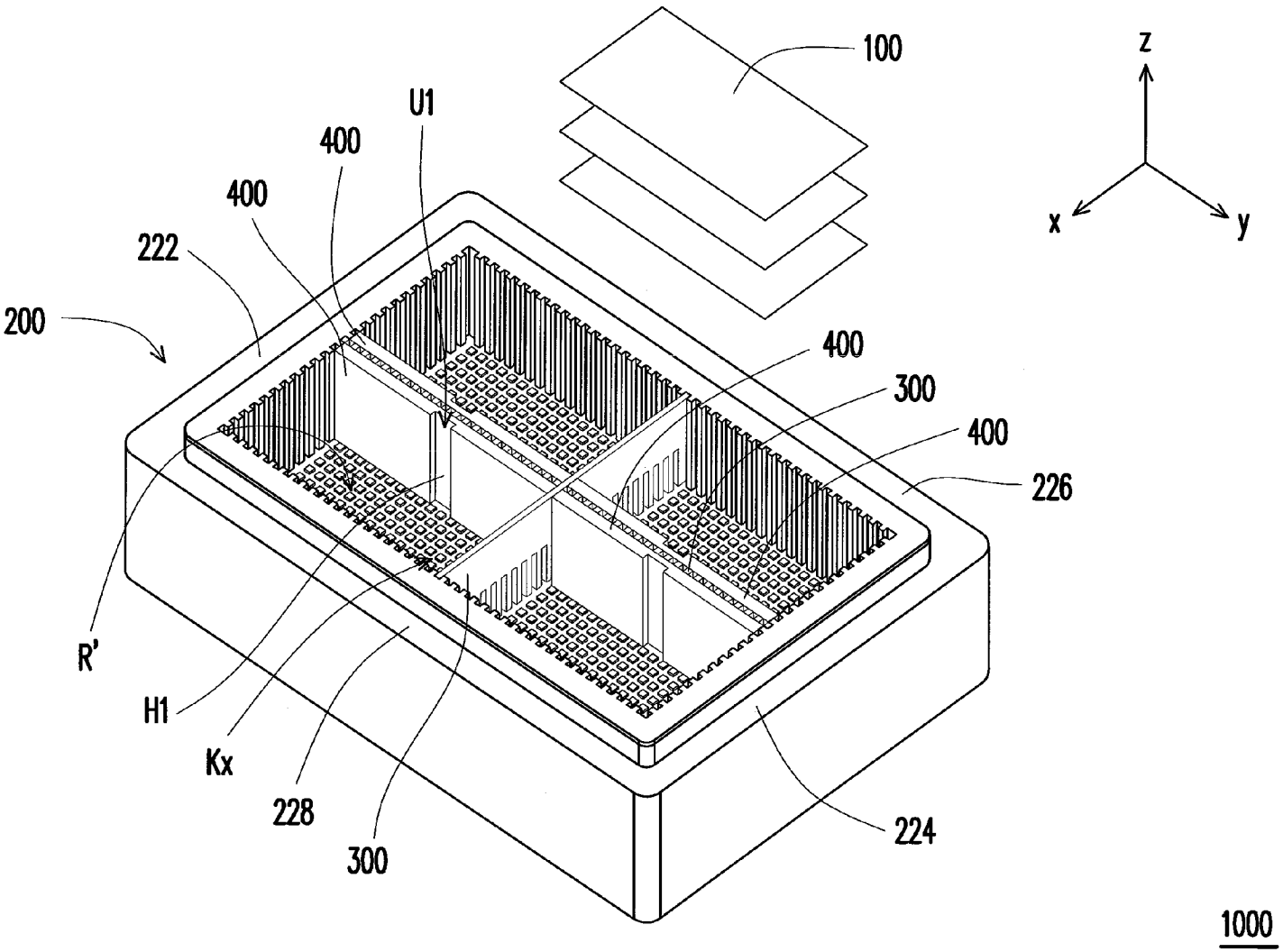

Referring to FIGS. 5 and 6, the box for transporting 1000 of the present embodiment can further include at least one pick-and-place auxiliary member 400. The pick-and-place auxiliary member 400 can be leant against a surface of the partition plate 300. In the present embodiment, the box for transporting 1000 can include four pick-and-place auxiliary members 400 which are respectively leant against a surface of the partition plate 300. Particularly, as shown in FIG. 6, the four pick-and-place auxiliary members 400 are respectively inlaid into the first sidewalls 222 and 224 and the partition plate 300 disposed on the supporting regions Kx, and thus the pick-and-place auxiliary members 400 are fixed in the box for transporting 1000. It should be noted that in the present embodiment, the pick-and-place auxiliary member 400 has a first groove U1, and an opening H1 of the first groove U1 is back facing the partition plate 300. Therefore, when the substrates 100 are stacked in the preserving sub-space R' and parallel to the bottom part 210, the user can pick the substrates 100 easily by approaching the sides of the substrates 100 through the first groove U1 with the finger. In the present embodiment, a material of the pick-and-place auxiliary member 400 is common material or antistatic material, such as high-density polypropylene (PP), high-density polyethylene (HDPE) and green paper plastic material.

Figure 7:
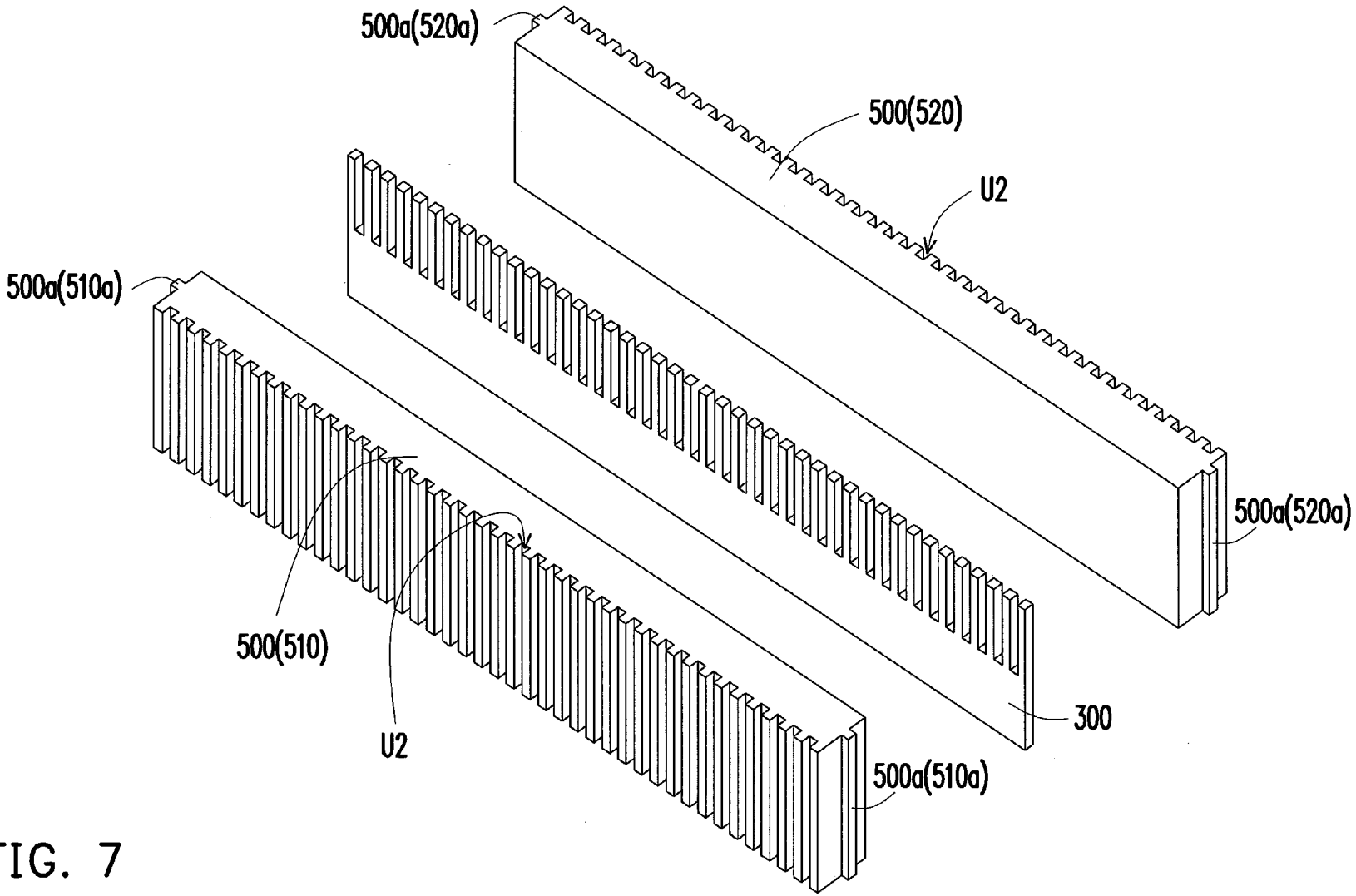
FIG. 7 is a schematic perspective view of illustrating an auxiliary member having grooves according to an embodiment of the invention.
Figure 8:
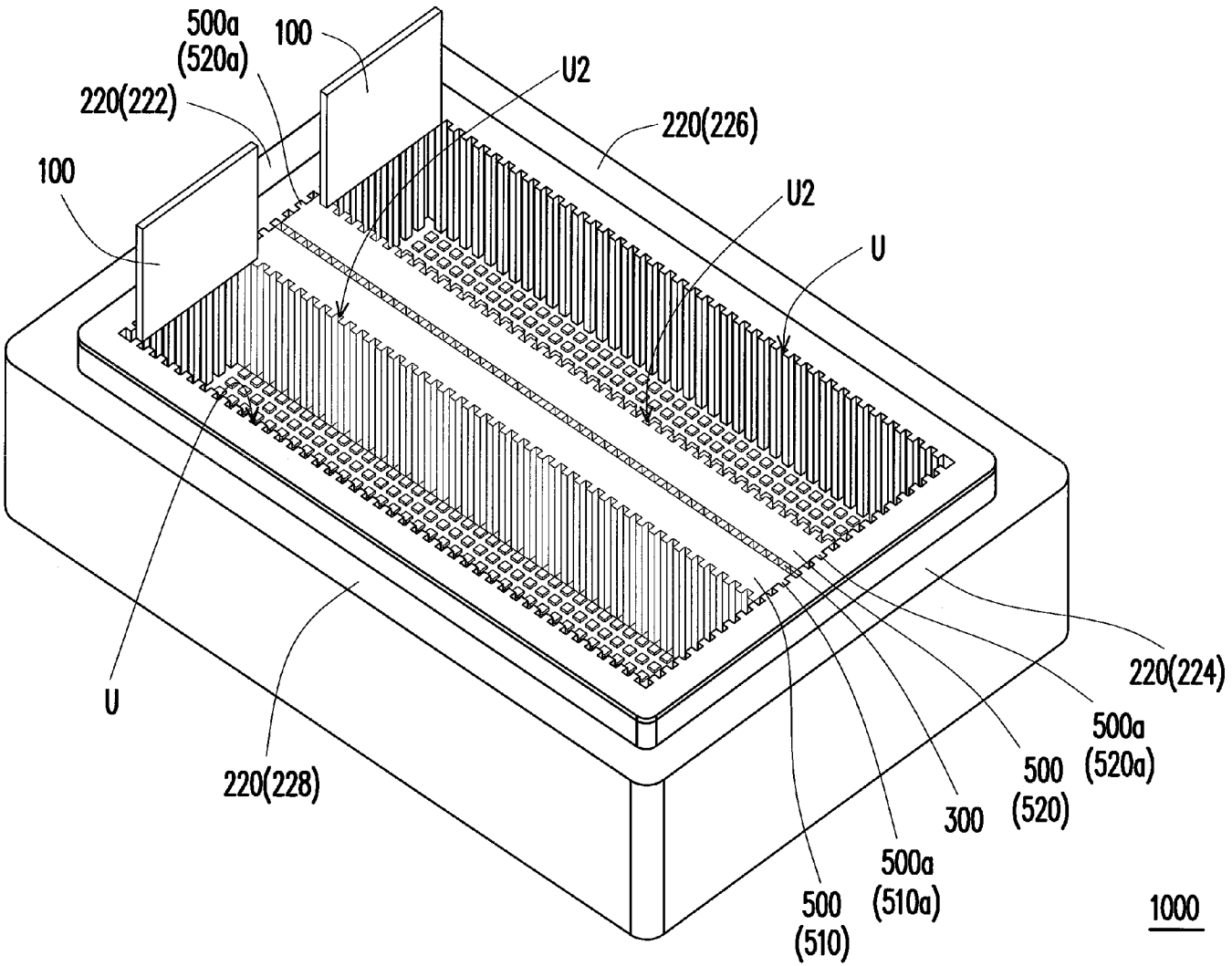

Referring to FIGS. 7 and 8, the box for transporting 1000 of the present embodiment can further include at least one auxiliary member having grooves 500. The auxiliary member having grooves 500 is inlaid into the first sidewall 220, and includes a plurality of second grooves U2. Openings of the second grooves U2 are facing openings of the major grooves U and disposed corresponding to the major grooves U. Particularly, the auxiliary members having grooves 510 and 520 can be leant against one partition plate 300 and inlaid between the first sidewalls 222 and 224, so as to be fixed in the box for transporting 1000. The openings of the second grooves U2 of the auxiliary member having grooves 510 are facing the first sidewall 228, and the said openings are aligned with the major grooves U of the first sidewall 228. Similarly, openings of the second grooves U2 of another auxiliary member having grooves 512 are facing the first sidewall 226, and the said openings are aligned with the major grooves U of the first sidewall 226. Therefore, a plurality of the substrate 100 can be inserted vertically respectively between the second groove U2 and the first sidewall 228 or 226. In the present embodiment, a material of the auxiliary member having grooves 500 is common material or antistatic material, such as high-density polypropylene (PP), high-density polyethylene (HDPE) and green paper plastic material.

In the present embodiment, the auxiliary member having grooves 500 can further include at least one protrusion portion 500*a*, the protrusion portion 500*a* is inlaid into the major groove U, and thus the auxiliary member having grooves 500 is fixed stably in the box for transporting 1000. In detail, the auxiliary member having grooves 510 can include two protrusion portions 510*a* which are respectively inlaid into the major groove U of the first sidewall 222 and the major groove U of the first sidewall 224, and thus the auxiliary member having grooves 510 is fixed stably in the box for transporting 1000. Similarly, the auxiliary member having grooves 520 can also include two protrusion portions 520*a* which are respectively inlaid into the major groove U of the first sidewall 222 and the major groove U of the first sidewall 224, and thus the auxiliary member having grooves 520 is fixed stably in the box for transporting 1000.

Figure 9:
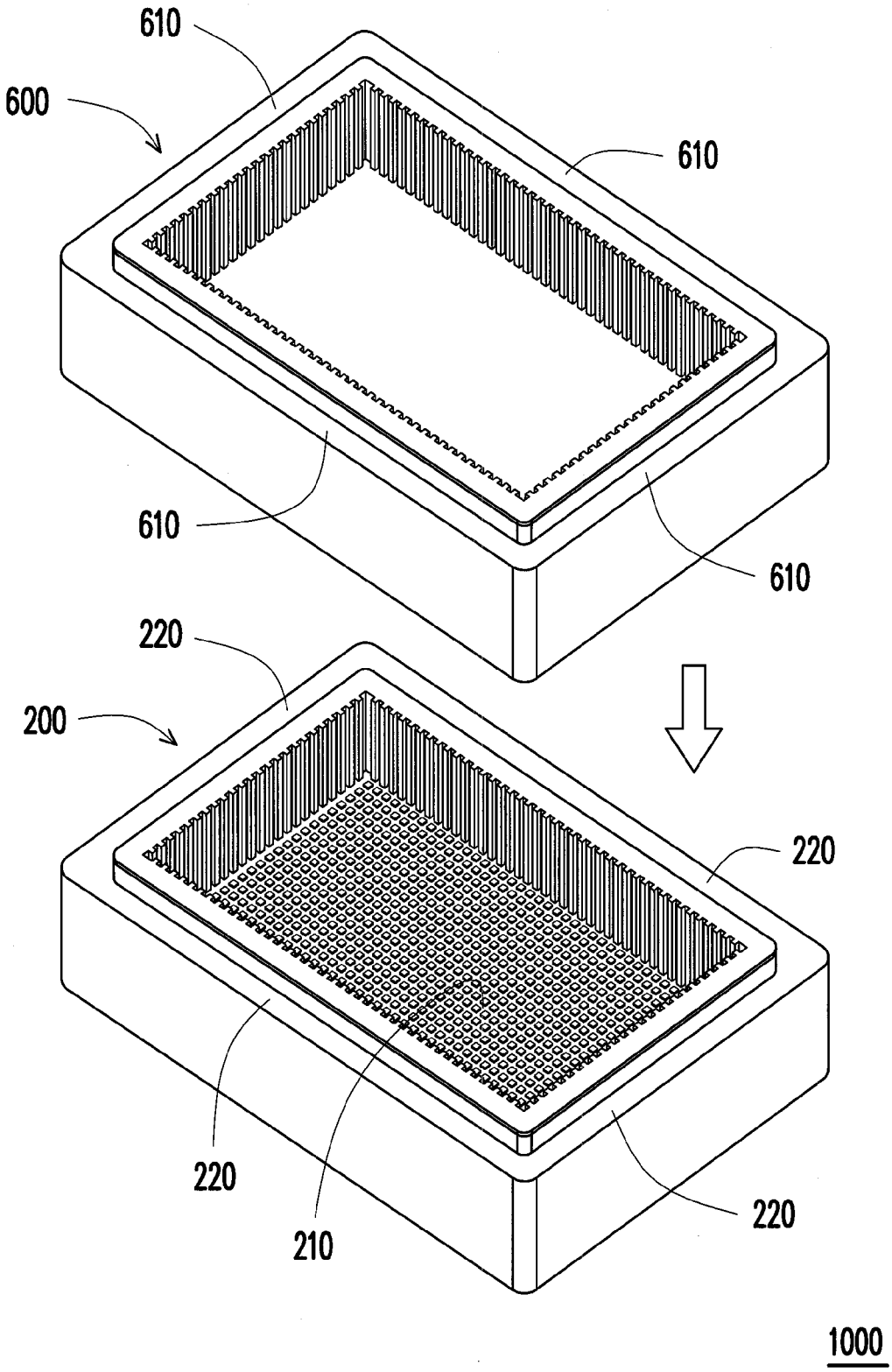
Figure 10:
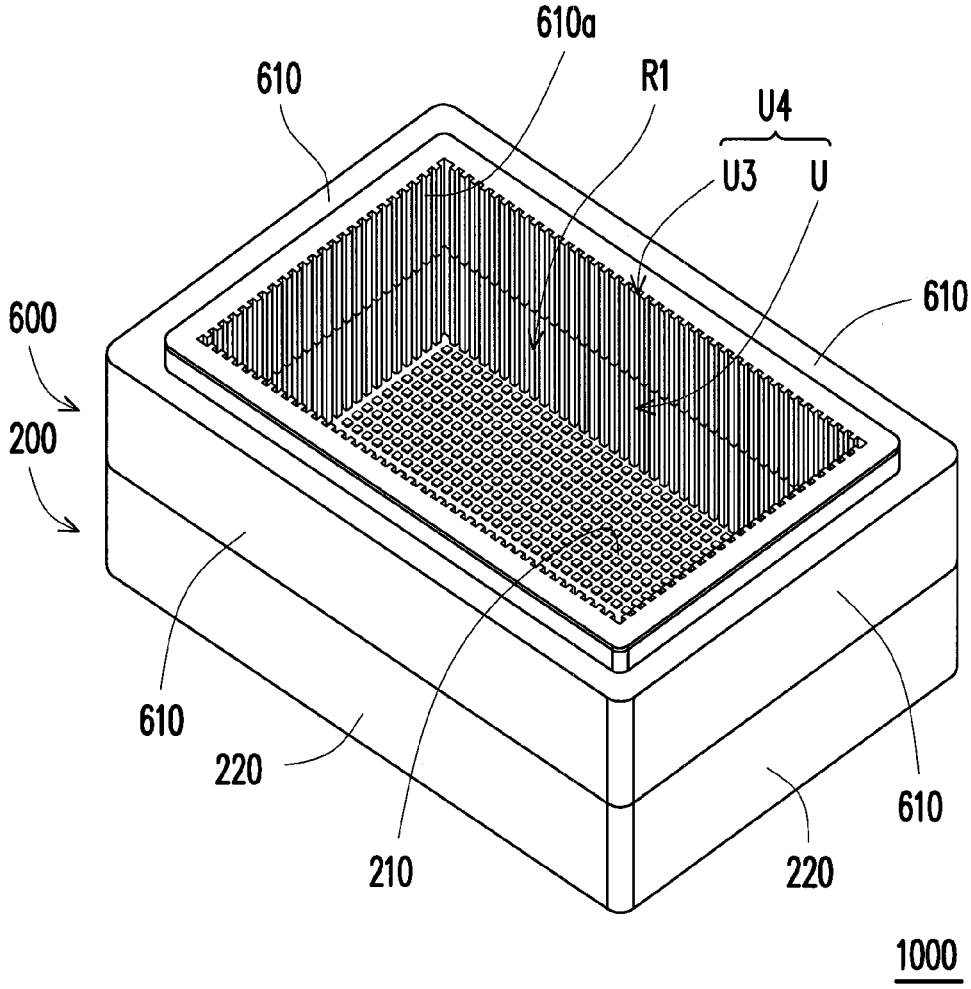

Referring to FIGS. 9 and 10, when the substrate 100 to be preserved has a larger size, the box for transporting 1000 of the present embodiment can further include a height increasing package 600. The height increasing package 600 can have a plurality of second sidewalls 610 connected to the first sidewalls 220 of the box body 200, wherein a second preserving space R1 is surrounded by the second sidewalls 610, the first sidewalls 220 and the bottom part 210. The capacity of the second preserving space R1 is larger than the capacity of the first preserving space R, for example. Accordingly, the box for transporting 1000 of the present embodiment is capable of preserving the substrates 100 with larger size, and application of the box for transporting 1000 is more flexible.

It is noted that in the height increasing package 600 of the present embodiment, a plurality of third grooves U3 is disposed in an inner surface 610*a* of the first sidewall 610, and the third grooves U3 are respectively connected to the major grooves U of the box body 200 to form a plurality of fourth grooves U4. Accordingly, the substrates 100 with larger size can be inlaid into the fourth grooves U4 with longer length than the major grooves U and disposed in the box for transporting 1000 more stably. In the present embodiment, a material of the height increasing package 600 is common material or antistatic material, such as high-density polypropylene (PP), high-density polyethylene (HDPE) and green paper plastic material.

Figure 11:
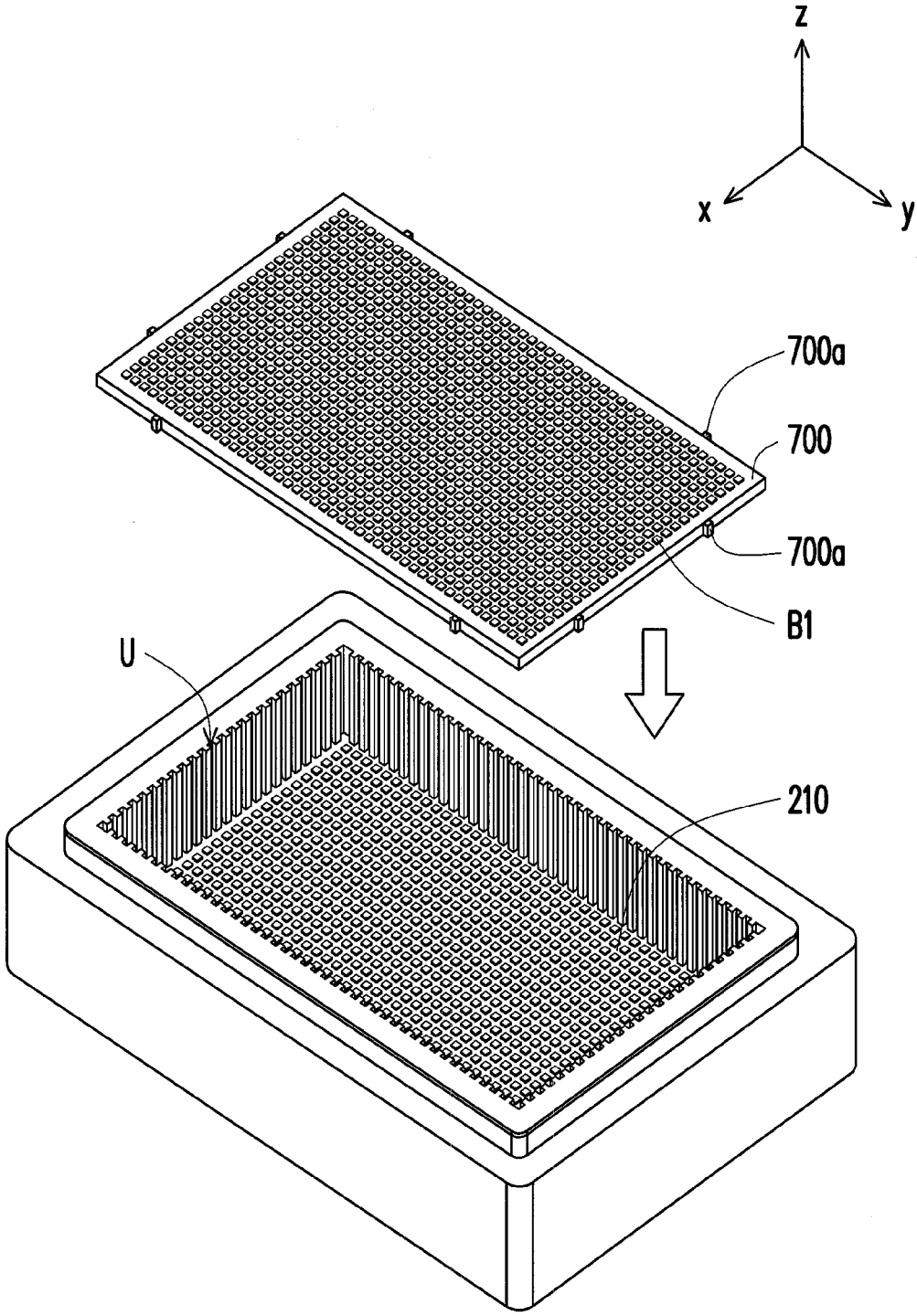

Referring to FIG. 11, the box for transporting 1000 of the present embodiment can further include at least one buffer package 700, and the buffer package 700 can be disposed on the bottom part 210. Particularly, a plurality of the second bumps B1 arranged in array can be disposed on a surface of the buffer package 700, and the surface of the buffer package 700 is parallel to the bottom part 210 and back facing the bottom part 210. Accordingly, when placing a small-dimension substrate 100 with a height less than a length of the major groove U in the z direction is placed, the buffer package 700 elevates the small-dimension substrate 100. Thus, the small-dimension substrate 100 can be placed stably in the box for transporting 1000. In addition, the buffer package 700 can include at least one protrusion portion 700*a*, the protrusion portion 700*a* is inlaid into the major groove U to fix the buffer package 700 stably in the box for transporting 1000. In the present embodiment, a material of the buffer package 700 is common material or antistatic material, such as high-density polypropylene (PP), high-density polyethylene (HDPE) and green paper plastic material.

Figure 12:
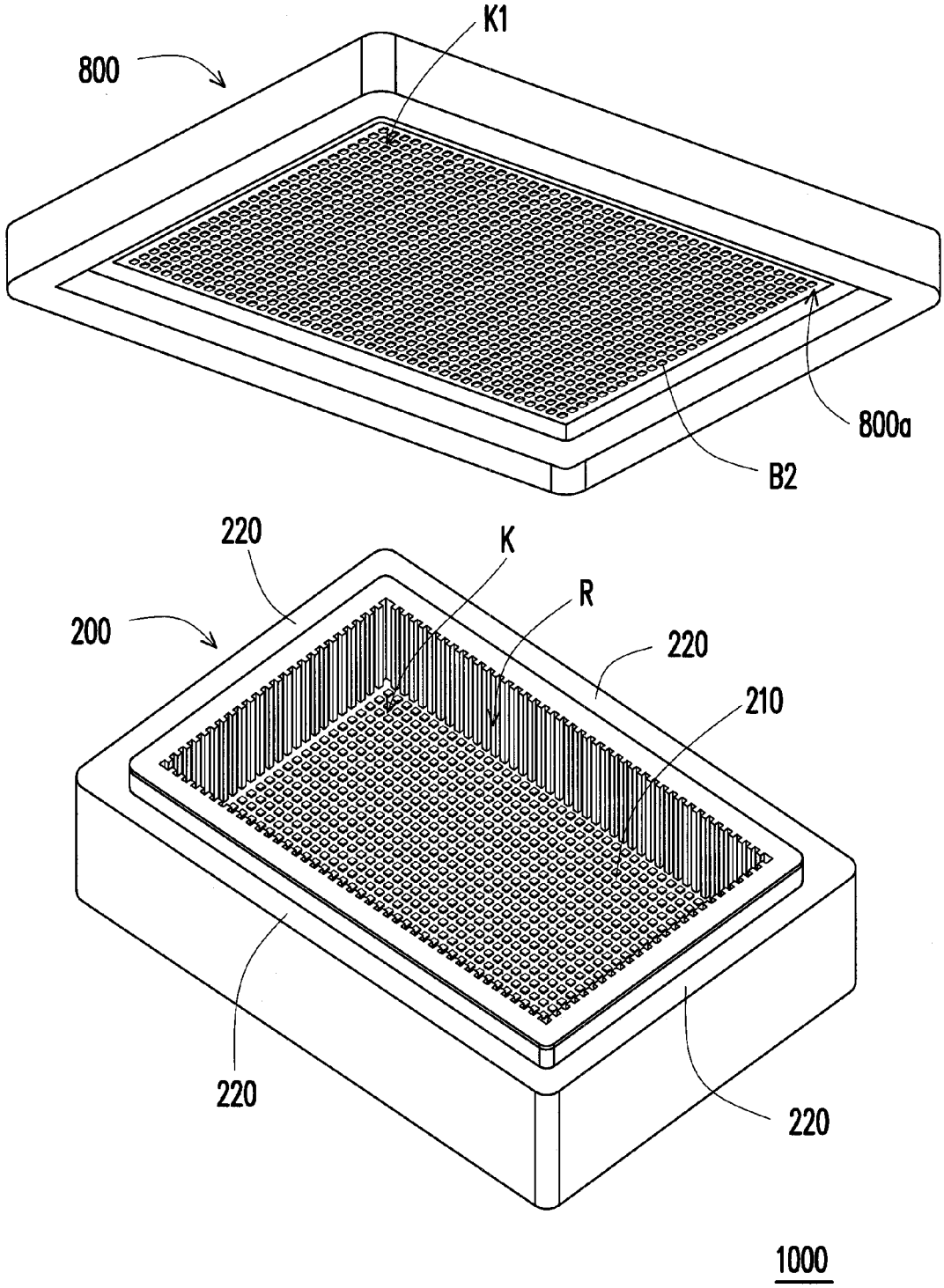

Referring FIG. 12, the box for transporting 1000 can further include an upper cover 800, the upper cover 800 is disposed above the box body 200 and connected to the first sidewalls 220 of the box body 200, so as to surround the preserving space R. The upper cover 800 has an inner surface 800*a* which is facing the bottom part 210. In the present embodiment, with the upper cover 800 contained, the substrate 100 can be disposed stably in the preserving space R of the box for transporting 1000. Therefore, the substrate 100 is prevented from dropping out of the box body 200 during the transportation process. Moreover, a plurality of the third bumps B2 arranged in array is selectively disposed on the inner surface 800*a* of the upper cover 800, and a plurality of first supporting regions K1 is defined by the third bumps B2. In the present embodiment, the first supporting regions K1 can be aligned with the supporting regions K. Accordingly, the partition plate 300 can be fixed more stably in the box for transporting 1000 through the first supporting regions K1 and the supporting regions K.

Figure 13:
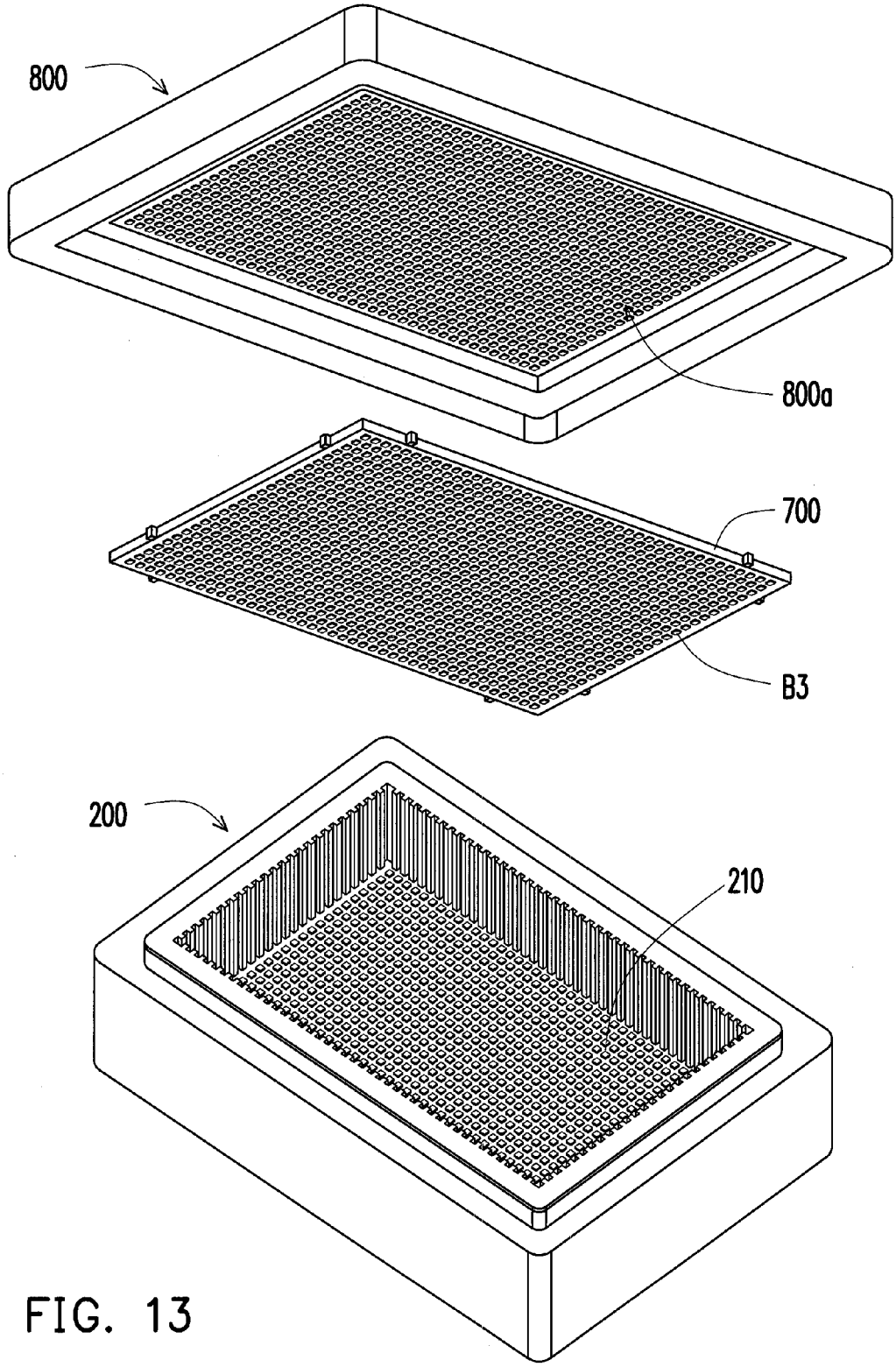
Figure 14:
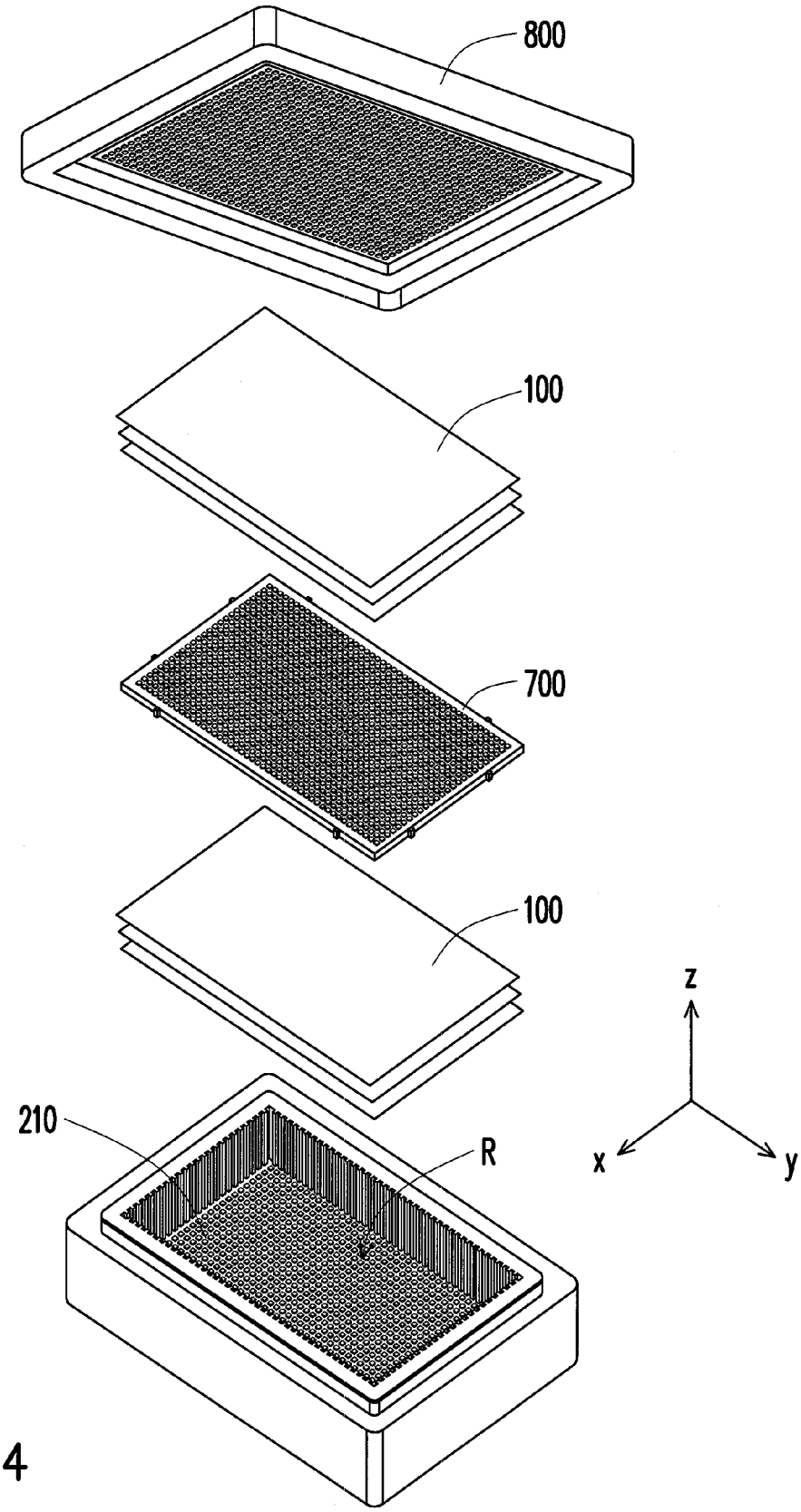

Referring to FIG. 13, the box for transporting 1000 of the present embodiment can further include another buffer package 700, and the buffer package 700 can be disposed on the inner surface 800*a* of the bottom part 800. In the present embodiment, a plurality of the fourth bumps B3 arranged in array can be disposed on a surface of the buffer package 700, and the surface of the buffer package 700 is parallel to and facing the bottom part 210. Similar to the description above, the partition plate 300 or substrates can be fixed more stably in the box for transporting 1000 through the buffer package 700. Moreover, as shown in FIG. 14, the buffer package 700 can be also disposed between the upper cover 800 and the bottom part 210. Therefore, the preserving space R is divided into two layers in the z direction to respectively preserve a plurality of substrates 100 with same size or different sizes. Accordingly, the application of the box for transporting 1000 is more flexible.

Figure 15:
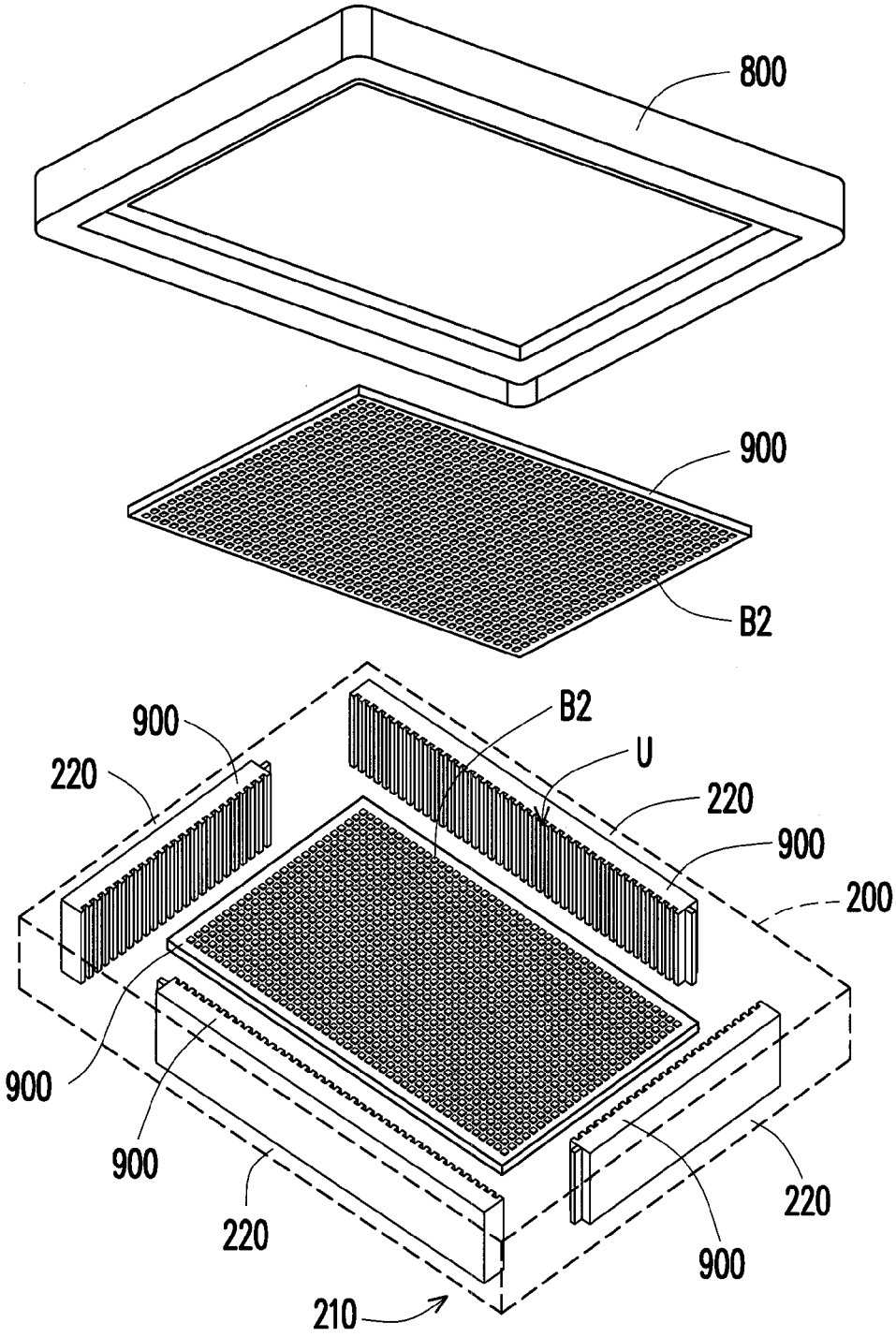

It is noted that the major gooves U and the first bumps B on the box body 200 and the box body 200 are formed integratedly, and the third bumps B2 on the upper cover 800 and the upper cover 800 are also formed integratedly. However, the invention is not limited to this embodiment, in other embodiments, the major grooves U, the first bumps B and the third bumps B2 can also be fabricated on a substrate 900 rather than the box body 200 and the upper cover 800. Then, as shown in FIG. 15, the substrates 900 are disposed on the first sidewalls 220, the bottom part 210 and the upper cover 800 corresponding thereto to form the box for transporting, which has the same function as the box for transporting 1000 described above.

Accordingly, in the box for transporting of the invention, the partition plate is leant against the supporting regions and inlaid into the major grooves to divide the preserving space into a plurality of preserving sub-spaces, so that the box for transporting is capable of preserving the substrates with various sizes. Moreover, in the invention, the application of the box for transporting can be broaden by using the auxiliary member having grooves, the height increasing package and the buffer package.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A box for transporting, suitable for preserving a plurality of substrates, and the box comprising:

a box body, comprising:

a bottom part, wherein a plurality of first bumps arranged in multi-columns and multi-rows is disposed on the bottom part and the first bumps are separated from each other, and the first bumps define a plurality of first supporting regions and a plurality of second supporting regions; and a plurality of first sidewalls, connected to the bottom part, wherein a plurality of major grooves is disposed in inner surfaces of the first sidewalls, and a first preserving space is surrounded by the bottom part and the first sidewalls;

at least two partition plates, one of the partition plates leant against one of the first supporting regions and inlaid into the major grooves located between two of the first sidewalls opposing to each other, and another of the partition plates leant against one of the second supporting regions and inlaid into the major grooves located between another two of the first sidewalls opposing to each other, so as to divide the first preserving space into a plurality of preserving sub-spaces.

2. The box for transporting as claimed in claim 1, further comprising an upper cover, disposed above the box body and connected to the first sidewalls of the box body, so as to surround the first preserving space, wherein the upper cover has an inner surface facing the bottom part.

3. The box for transporting as claimed in claim 2, wherein a plurality of third bumps arranged in array is disposed on the inner surface of the upper cover.

4. The box for transporting as claimed in claim 1, further comprising a buffer package disposed on the bottom part.

5. The box for transporting as claimed in claim 4, wherein the buffer package has at least one protrusion portion, and the protrusion portion of the buffer package is inlaid into the major grooves, so as to fix the buffer package in the box for transporting.

6. The box for transporting as claimed in claim 4, wherein a plurality of second bumps arranged in array is disposed on a surface of the buffer package, and the surface of the buffer package is parallel to and back facing the bottom part.

7. The box for transporting as claimed in claim 2, further comprising a buffer package disposed on the inner surface of the upper cover.

8. The box for transporting as claimed in claim 7, wherein the buffer package has at least one protrusion portion, and the protrusion portion of the buffer package is inlaid into the major grooves, so as to fix the buffer package in the box for transporting.

9. The box for transporting as claimed in claim 7, wherein a plurality of fourth bumps arranged in array is disposed on a surface of the buffer package, and the surface of the buffer package is parallel to and facing the bottom part.

10. The box for transporting as claimed in claim 2, further comprising at least one buffer package disposed between the upper cover and the bottom part.

11. The box for transporting as claimed in claim 10, wherein the buffer package has at least one protrusion portion, and the protrusion portion of the buffer package is inlaid into the major grooves, so as to fix the buffer package in the box for transporting.

12. The box for transporting as claimed in claim 1, wherein the partition plate is comb-shaped.

13. The box for transporting as claimed in claim 1, further comprising a pick-and-place auxiliary member leant against a surface of the partition plate, wherein the pick-and-place auxiliary member has at least one first groove, and an opening of the first groove is back facing the surface of the partition plate.

14. The box for transporting as claimed in claim 1, further comprising at least one auxiliary member having grooves, wherein the auxiliary member having grooves is inlaid into the major grooves and has a plurality of second grooves, openings of the second grooves are facing openings of the major grooves, and the second grooves are disposed corresponding to the major grooves.

15. The box for transporting as claimed in claim 14, wherein the auxiliary member having grooves has at least one protrusion portion, and the protrusion portion of the auxiliary member having grooves is inlaid into the major grooves, so as to fix the auxiliary member having grooves in the box for transporting.

16. The box for transporting as claimed in claim 1, further comprising a height increasing package, and the height increasing package comprising:

a plurality of second sidewalls, connected to the first sidewalls of the box body, wherein a second preserving space is surrounded by the second sidewalls of the height increasing package, the first sidewalls of the box body and the bottom part of the box body, and capacity of the second preserving space is larger than capacity of the first preserving space.

17. The box for transporting as claimed in claim 16, wherein inner surfaces of the second sidewalls have a plurality of third grooves, and the third grooves are connected with the major grooves to form a plurality of fourth grooves.

* * * * *